US007666123B2

(12) United States Patent
Giannelli

(10) Patent No.: US 7,666,123 B2
(45) Date of Patent: Feb. 23, 2010

(54) UPPER TORSO EXERCISE MACHINE

(75) Inventor: Raymond Giannelli, Franklin, MA (US)

(73) Assignee: Cybex International, Inc., Medway, MA (US)

( * ) Notice: Subject to any disclaimer, the term of this patent is extended or adjusted under 35 U.S.C. 154(b) by 500 days.

(21) Appl. No.: 10/379,420

(22) Filed: Mar. 4, 2003

(65) Prior Publication Data

US 2003/0158019 A1 Aug. 21, 2003

Related U.S. Application Data

(63) Continuation-in-part of application No. 10/293,041, filed on Nov. 13, 2002, now abandoned.

(60) Provisional application No. 60/337,737, filed on Nov. 13, 2001, provisional application No. 60/361,623, filed on Mar. 4, 2002.

(51) Int. Cl.
*A63B 21/062* (2006.01)
*A63B 23/02* (2006.01)

(52) U.S. Cl. ..... 482/100; 482/72; 482/137

(58) Field of Classification Search ..... 482/72, 482/92–94, 97–101, 133–138, 142; D21/673–676
See application file for complete search history.

(56) References Cited

U.S. PATENT DOCUMENTS 2,921,791 A * 1/1960 Berne ..... 482/118
4,650,181 A * 3/1987 Yang ..... 482/73
5,004,224 A * 4/1991 Wang ..... 482/53
5,044,632 A 9/1991 Jones
5,050,873 A 9/1991 Jones
D321,026 S * 10/1991 Jones ..... D21/676
5,135,449 A 8/1992 Jones
5,135,456 A 8/1992 Jones
5,181,894 A * 1/1993 Shieng ..... 482/70
5,181,896 A 1/1993 Jones
5,273,504 A 12/1993 Jones
5,273,505 A 12/1993 Jones
5,304,107 A 4/1994 Jones
5,554,089 A 9/1996 Jones (Continued)

FOREIGN PATENT DOCUMENTS

DE 29705990 U1 * 9/1998

(Continued)

OTHER PUBLICATIONS

Tuff-Stuff, CT-730 Seated Row, Commercial Strength Equipment: Plate Loaded and Free Weight Systems brochure.*

*Primary Examiner*—Loan H Thanh
*Assistant Examiner*—Victor K Hwang
(74) *Attorney, Agent, or Firm*—Rissman Hendricks & Oliverio LLP

(57) ABSTRACT

The subject invention provides an upper body exercise machine with increased joint range of motion along with more consistently applied torque to the joint throughout the entire range of exercise. The exercise machine includes dual axis, dual hinge mechanisms enabling a user emulate the natural biomechanical motion associated with free weights, while maintaining the stability of an exercise machine and providing more consistent loading than free weights. The dual axis, dual hinge mechanisms permit the handles to be independently or in combination moved longitudinally and laterally in a relationship selected by the user.

20 Claims, 13 Drawing Sheets

U.S. PATENT DOCUMENTS

| | | | | | |
|---|---|---|---|---|---|
| 5,597,375 | A | | 1/1997 | Simonson | |
| RE35,470 | E | | 3/1997 | Jones | |
| 5,620,402 | A | | 4/1997 | Simonson | |
| 5,643,152 | A | | 7/1997 | Simonson | |
| 5,665,033 | A | * | 9/1997 | Palmer | 482/71 |
| 5,667,464 | A | | 9/1997 | Simonson | |
| 5,788,614 | A | | 8/1998 | Simonson | |
| 5,810,701 | A | | 9/1998 | Ellis et al. | |
| 5,957,817 | A | * | 9/1999 | Koenig et al. | 482/72 |
| 6,004,247 | A | | 12/1999 | Webber | |
| 6,071,216 | A | | 6/2000 | Giannelli et al. | |
| 6,142,917 | A | | 11/2000 | Giannelli et al. | |
| D439,941 | S | * | 4/2001 | Batca et al. | D21/676 |
| 6,579,213 | B1 | * | 6/2003 | Webber et al. | 482/100 |
| 6,746,378 | B2 | * | 6/2004 | Morris et al. | 482/100 |
| 6,830,542 | B2 | * | 12/2004 | Ball et al. | 482/72 |
| 6,910,994 | B2 | * | 6/2005 | Mitchell et al. | 482/100 |
| 2002/0035017 | A1 | * | 3/2002 | Pertegaz-Esteban | 482/92 |
| 2002/0052268 | A1 | * | 5/2002 | Morcillo-Quintero et al. | 482/92 |
| 2006/0073942 | A1 | * | 4/2006 | Yang | 482/53 |

FOREIGN PATENT DOCUMENTS

| | | | | |
|---|---|---|---|---|
| DE | 19713888 | A1 | * | 10/1998 |
| EP | 1033151 | A2 | * | 9/2000 |

* cited by examiner

UPPER TORSO EXERCISE MACHINE

CROSS-REFERENCE TO RELATED APPLICATION

This application is related to and claims priority to U.S. Provisional Patent Application Ser. No. 60/361,623, filed Mar. 4, 2002, entitled INCLINE PULL MACHINE, and is a continuation-in-part of U.S. application Ser. No. 10/293,041, filed Nov. 13, 2002, entitled UPPER TORSO EXERCISE MACHINE, now abandoned, which claims priority to U.S. Provisional Patent Application No. 60/337,737, filed Nov. 13, 2001, entitled CHEST PRESS, the entireties of which are incorporated herein by reference.

STATEMENT REGARDING FEDERALLY SPONSORED RESEARCH OR DEVELOPMENT n/a

FIELD OF THE INVENTION

The present invention relates to the field of exercise and physical rehabilitation equipment, and in particular to an apparatus for exercising the upper torso.

BACKGROUND OF THE INVENTION

It is often necessary or desirable for a person to exercise a particular muscle or group of muscles. For example, when a muscle is damaged, such as through injury or surgery, it is important to exercise the muscle to prevent atrophy and to strengthen the muscle for normal use. Further, people exercise healthy muscles to increase strength and to maintain an active and healthy lifestyle, as well as to improve their appearance. Various routines have been developed to exercise different muscle groups by forcing the muscles to contract and extend under a load, such as by moving a free weight against the force of gravity or by moving a handle whose movement is resisted by an exercise machine.

One such exercise is known as a chest press. An exerciser lies supine on a bench and grasps a barbell above the exerciser. The exerciser then pushes the barbell upward, away from his chest, and lowers it down. This exercise can be dangerous as the exerciser may drop the barbell. Further, the exerciser should have a partner to spot him in case he fails to lift the weight and becomes trapped below it. Even if done properly with a partner, this exercise may not permit the user a full range of exercise since the barbell may hit the user's chest before the chest and arm muscles have extended fully. When using free weights, the force provided by gravity is constant while the mechanical advantage of the weights on the joints and the strength of the muscles varies over the range of motion. Consequently, the muscles are not fully loaded at each point over the range. During a chest press, the hands seek to follow a curved path inward as the weight is extended from the chest. This path cannot be followed when using a barbell because the hands are maintained at a fixed distance. Alternatively, dumbbells will allow the full range of join motion for the exercise but cannot apply consistent resistance to the joint.

To overcome these difficulties, machines have been developed that simulate the exercise movements of a chest press. In one known apparatus a user exercises by pushing handles away from his chest while in a sitting position. A seat and backrest are mounted to a frame to position a user. Two arms are rotatably mounted as a unit to the frame. The handles are mounted to the arms. The pivot for the arms is disposed above the seat. A cable operably connects the arms to a weight stack such that when a user pushes on the handles, thereby rotating the arms, the weight stack is lifted and provides resistance to the exercise. The cable may extend over a variable radius cam, which alters the distance the weight is displaced for a given amount of handle rotation. In this configuration, the resistance to the movement of the handles can be varied to match the strength curve of the chest muscles. While such an apparatus solves many problems associated with performing a chest press exercise with barbells or dumbbells, it does not permit the user to vary the distance between his hands while performing the exercise.

In another apparatus, disclosed in U.S. Pat. No. 5,044,631, an exercise machine provides levers that are rotatably mounted to a frame above the seated user. Handles are mounted to the levers. Resistance to handle movement is provided by weight plates mounted to the levers. The hinges for the levers are disposed at an angle of 20 degrees with respect to a central vertical midline, such that the user must move his hands in defined arcs in converging planes as he presses forward on the handles. This apparatus forces the user's hands to be brought together at a preset rate as they are pressed away from the chest, regardless of the user's anatomy. This apparatus does not permit the user to select his own path of motion for the press exercise. Rather, the motion is dictated by the angle of the hinges.

An exercise that develops the back muscles is called an incline pull or high row. This exercise involves a pulling motion, wherein a person grips a load with his/her hands, and pulls the load from an arm-extended position to an arms-bent position using primarily the muscles of the back, such as the latissimus dorsi, in addition to ancillary muscles, such as the rear deltoids. The plane of motion is substantially parallel to an imaginary plane bisecting the symmetric halves of the body, such that the arms and elbows are bent and close up against the torso at the end of the motion when the muscles are fully contracted. A "regular" pull or rowing type exercise places the range of motion substantially perpendicular to the longitudinal axis of the torso, and targets the entire range of back muscles. A traditional Lat pull-down range of motion (similar to a pull-up or chin-up) places the range of motion substantially parallel with the major axis of the torso, targeting primarily the latissimus muscles. The "incline pull" is a variation wherein the starting position of the extended arms places the hands at a point above the chest and in front of the head, such that the range of motion is along a path that is angled with respect to both the perpendicular and parallel axes of the torso, allowing for a person to target the muscles in a way that is a mix between the rowing motion and the pull-down motion.

A key variable to the pulling exercise motion is the degree to which the hands are separated and arms are extended away from each other, the so-called "width" of a person's grip. A narrow grip tends to target more of the arm muscles involved in the pulling motion, such as the biceps, and lessens the emphasis on the back muscles. A wider grip puts more emphasis on the back muscles, limiting the range of contraction of the elbows while specifically targeting the latissimus. Known machines provide a range of motion for either a narrow or a wide grip, but do not allow a person to vary the grip during the range of motion.

SUMMARY OF THE INVENTION

The subject invention provides an upper body exercise machine with increased joint range of motion along with more consistently applied torque to the joint throughout the entire range of exercise. As described herein, the exercise machine includes independent dual axis, dual hinge mechanisms enabling a user to emulate the natural motion associated with some free weights, while maintaining the stability of an exercise machine.

The exercise machine of the subject invention provides an upper torso exercise machine, for example a chest press machine. The chest press machine includes a support frame to which a user support structure is mounted. The user support structure includes an adjustable seat and a backrest, where the adjustable seat is adapted to be positioned at various heights along the support frame, providing a comfortable starting position and allowing a full range of motion for users of varying stature. In an exemplary embodiment, the seat and the backrest are in a partially reclined position.

Lifting arms are mounted to the support frame by a pair of dual axis, dual hinge mechanisms, where the hinge mechanisms are opposingly mounted onto the support frame. The hinge mechanisms include a pair of primary hinges and a pair of secondary hinges. The primary hinges are mounted to the support frame and located above the seat, where the primary hinges are mounted as mirror images of each other. The primary hinges include primary bearing tubes mounted on sealed bearings and rotatable about primary hinge axes. The secondary hinges are rotatably mounted to the primary hinges, and include secondary bearing tubes mounted to sealed bearings and rotatable about secondary hinge axes. The secondary hinge axes are skew to the primary hinge axes; in other words, the secondary hinge axes are not parallel to the primary hinge axes.

The dual axis, dual hinge mechanisms operate to divide the resistance provided by the weight stack into a longitudinal component and a lateral component. These separated components of resistance increase the effectiveness of the exercise by more consistently loading the muscles throughout the range of motion and in addition, provide feedback to the user that encourages symmetrical exercise paths of the right and left hands.

Handles are mounted at the end of the arms distal to the secondary bearing tubes. The handles present the user with a barbell grip. Alternatively, a variable position handle such as a pivoting handle, or a pad for pushing with the user's arm, wrist or elbow, can be attached to the arm to permit the user to perform other exercises.

The arms are operably connected to the weight stack via the transmission system and lifting cables, where the transmission system includes a rotatable eccentric shaped cam operably connected to a weight stack. As the user presses forward and inward on the handles the transmission system is caused to rotate, lifting the weight stack.

To operate the apparatus of the present invention, a weight is selected on the main weight stack by placing a pin in one of the holes, as is known in the art. The user adjusts the seat to a suitable position. For example, a user with a longer torso will adjust the seat to a lower height such that the handles are positioned at a comfortable height near the user's chest. The user then grasps the handles and pushes forward. The movement of the handles causes the arms to move which, causes the primary bearing tubes to rotate which, in turn, causes the transmission system to rotate, rotating the cam, and lifting the selected weight. The user then returns the handles to the initial position, thereby lowering the weight. When the user pushes the handles in the forward direction (concentric action), the resistance provided by the weight is overcome. When the user returns the handles (eccentric action), the user succumbs to the resistance provided by the weight.

The dual axis, dual hinge mechanisms permit the handles to be independently or in combination moved forward (i.e., longitudinally) and inward (i.e., laterally) in a relationship selected by the user. The two different modes of operation available to the user are machine defined path or user defined path. In the machine defined path, the user would push in the forward direction and the arms would be restricted to a natural converging path motion defined by the angular orientation of the primary axis which would be approximately 20 to 25 degrees convergent per side to the midplane of the machine in the direction of the users forward motion. No path of motion less convergent than the machine defined path would be available to the user. Under the second mode of operation, the user would start out by pushing inward as well as forward. In this mode once the user exceeds a component of lateral force set by the machine geometry, they are free to move inward as much as desired in addition to moving forward. In the user defined mode, any path of motion that is more convergent than the machine defined path is available to the user at any time.

Alternatively, the independent dual axis, dual hinge mechanisms can be employed on an upper torso pulling exercise machine, for example an incline row machine, enabling a user to maintain the proper biomechanical motion, while maintaining a consistent resistance applied to the muscles, in the stability of an exercise machine. An upper torso pulling exercise machine likewise includes a frame having a pair of dual axis, dual hinge mechanisms independently mounted thereon. A pair of arms mounted one each to the pair of dual axis, dual hinge mechanisms, such that the arms travel a substantially divergent path as the arms are pulled back.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The subject invention provides an upper body exercise machine with increased longitudinal and lateral range of motions while offering a consistent resistance throughout the range of motion of the joints being trained. As described herein, the exercise machine includes independent dual axis, dual hinge mechanisms enabling a user to emulate the natural motion associated with free weights, while maintaining a consistent resistance applied to the muscles, in the stability of an exercise machine.

Figure 1:
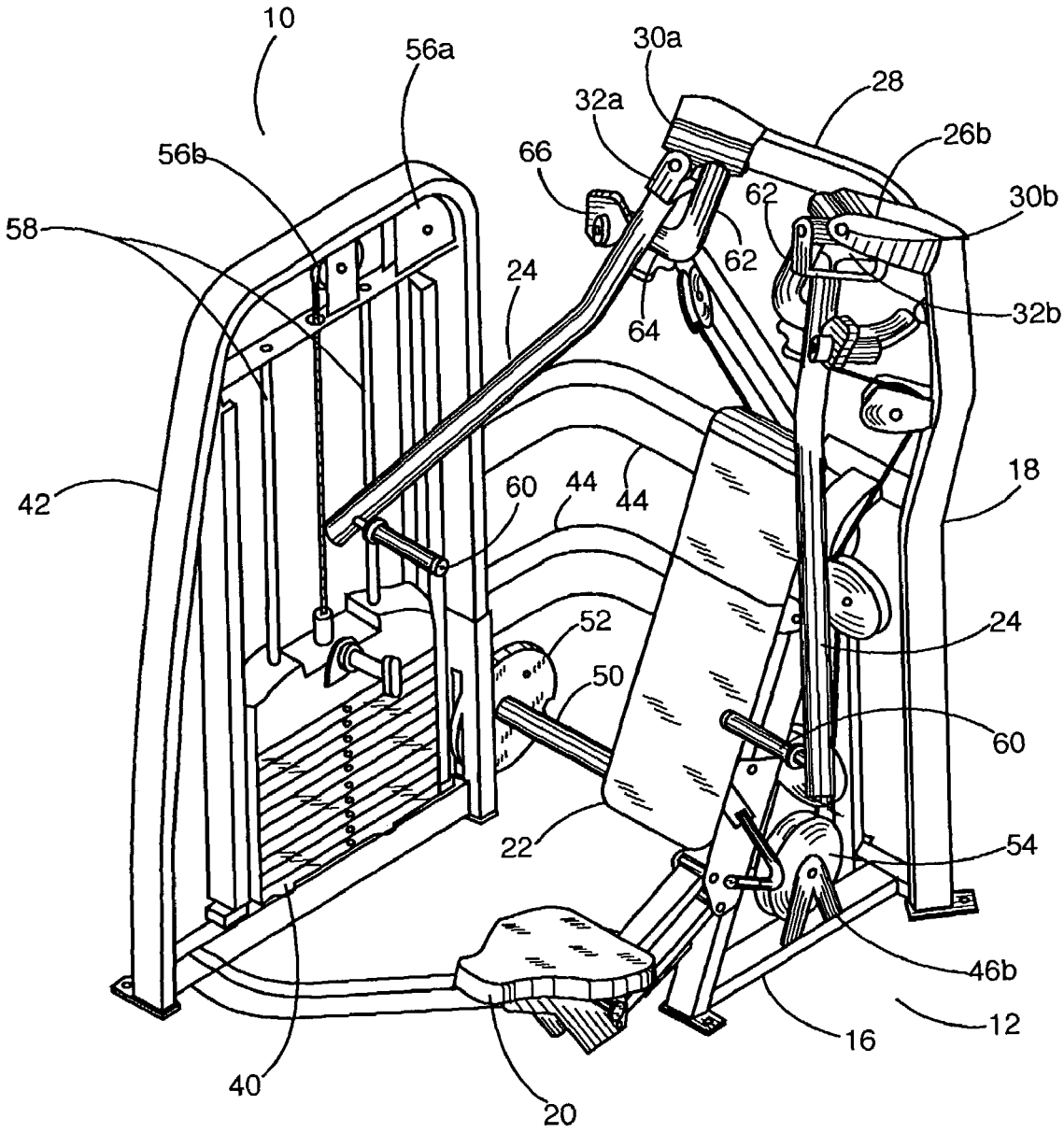
FIG. 1 is a perspective view of a chest press machine of the present invention.
Figure 2:
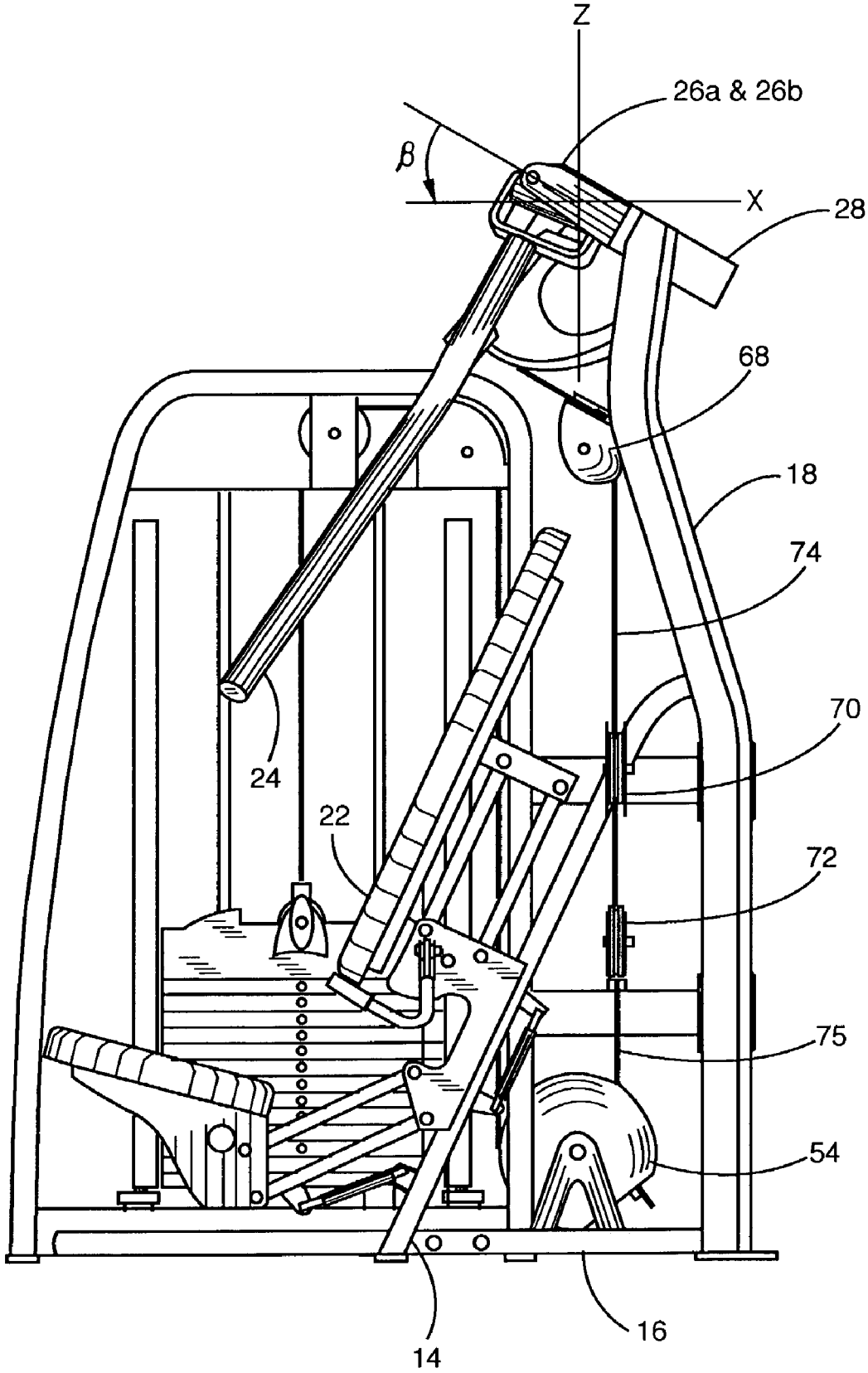
FIG. 2 is left side view of a chest press machine of the present invention.

In an exemplary embodiment, as shown in FIGS. 1 and 2, the exercise machine 10 of the present invention includes a support frame 12 having a front leg 14, rear base 16, and a vertical support 18. A seat 20 is mounted to the front leg 14 of the support frame 12. The seat 20 is adapted to be positioned at various heights along the front leg 14 to provide a comfortable starting position and the proper alignment of the shoulder for users of varying stature. A backrest 22 is mounted on the front leg 14 above the seat 20, wherein the backrest 22 defines a plane. Although this machine is shown to have a minimally inclined backrest, other configurations provide various degrees of incline. As shown, the front leg 14 angles away behind the seat 20 in an upward direction such that the backrest 22 is in a partially reclined position. The seat 20 and backrest 22 comprise a user support adapted to maintain the user in a comfortable position for exercising.

Figure 3:
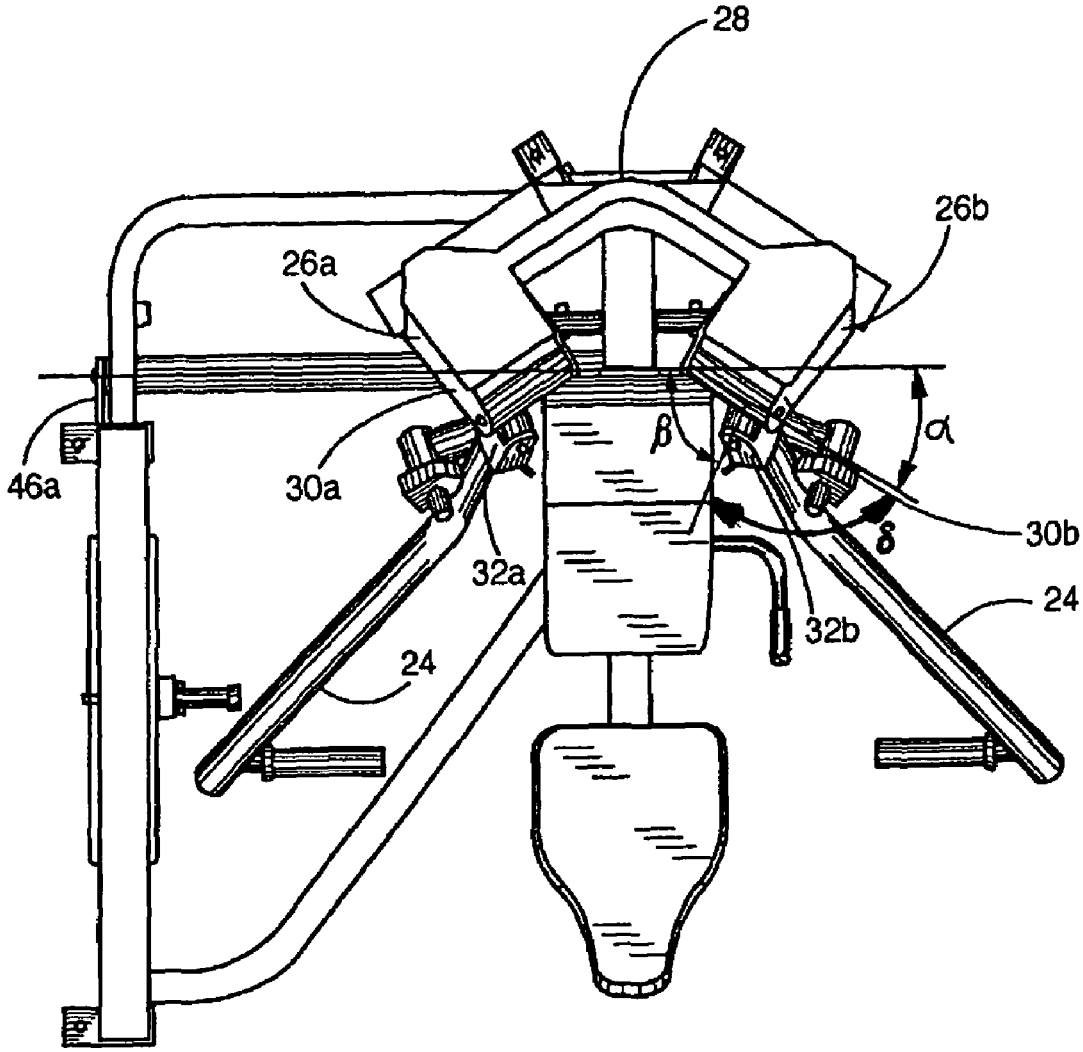
FIG. 3 is a top view of a chest press machine of the present invention.

As shown in FIGS. 1 and 3, the arms 24 are mounted to the support frame 12 by independent dual axis, dual hinge mechanisms 26*a* and 26*b*, where the hinge mechanisms 26*a* and 26*b* are mounted on vertical support 18 with hinge bracket 28. The hinge bracket 28 is mounted to the vertical support, such that the hinge mechanisms 26*a* and 26*b* are at an angle β from the horizontal plane, wherein the angle β can be between about −30 degrees to about +30 degrees. The hinge mechanisms 26*a* and 26*b* include primary hinges 30*a* and 30*b* and secondary hinges 32*a* and 32*b*. The primary hinges 30*a* and 30*b* are mounted to the hinge bracket 28 and also located above the seat 20. The primary hinges 30*a* and 30*b* are mounted as non-parallel, non-planar mirror images of each other, disposed in a skewed orientation to the plane defined by the backrest 22. The dual hinge mechanisms 26*a* and 26*b* are mounted to the hinge bracket 28 such that the axes of rotation of the primary hinges 30*a* and 30*b* are at an angle α to plane A, as defined by the backrest 22. The angle α can be between about 10 degrees to about 45 degrees, wherein for the exemplary embodiment exercise machine α can be between about 20 degrees to about 25 degrees. The secondary hinges 32*a* and 32*b* are mounted to the primary hinges 30*a* and 30*b*, such that the rotational axes of the secondary hinges 32*a* and 32*b* are skewed with respect to the rotational axes of the primary hinge 30*a* and 30*b*; in other words, the secondary hinges 32*a* and 32*b* axes are not parallel to the primary hinges 30*a* and 30*b* axes. The rotational axes of the secondary hinges 32*a* and 32*b* are at an angle δ to the rotational axes of the primary hinges 30*a* and 30*b*. The angle δ can be between about 80 degrees to about 100 degrees, wherein for the exemplary embodiment exercise machine δ is about 90 degrees.

While in the current embodiment the primary hinges 30*a* and 30*b* are disposed directly above the rear of the backrest 22 (see FIG. 2), they can be located in other positions and still practice the invention. In particular, the primary hinges 30*a* and 30*b* can be positioned in front or behind the backrest 22 to vary the direction of handle motion, providing a declined press or an inclined press exercise, respectively.

Figure 4:
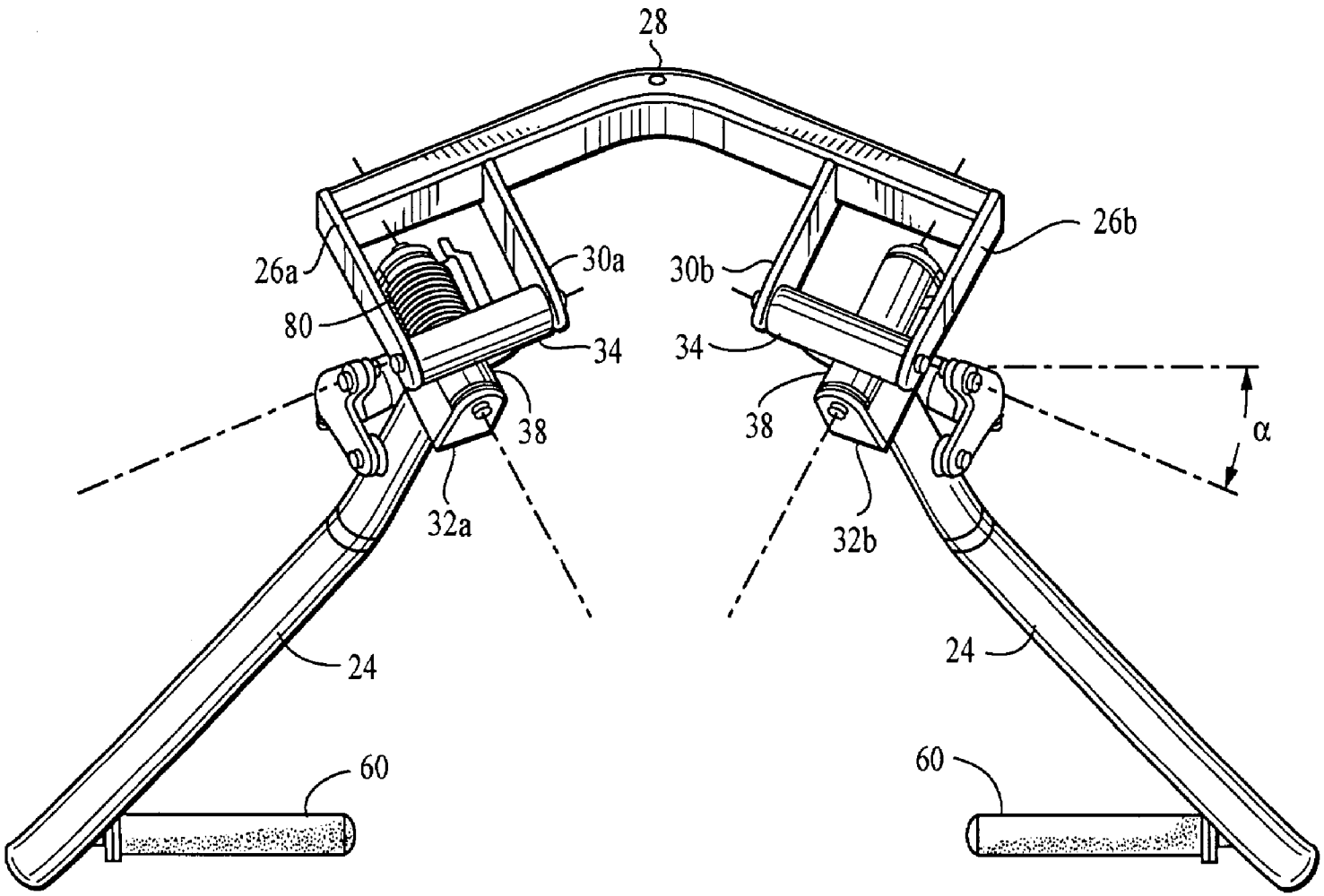
FIG. 4 is a perspective view of the dual axis, dual hinge mechanisms of the present invention.

In an embodiment, as shown in FIG. 4, the primary hinges 30*a* and 30*b* includes a primary bearing tube 34 mounted on sealed bearings (not shown) and rotatable about the rotational axes of the primary hinges 30*a* and 30*b*. The secondary hinges 32*a* and 32*b* include secondary bearing tubes 38 mounted to sealed bearings (not shown) and rotatable about the secondary hinge's 32*a* and 32*b* axes of rotation. The secondary bearing tubes 38 are affixed to the primary bearing tubes 34 such that as the secondary bearing tubes 38 are rotated about the secondary hinge's 32*a* and 32*b* axes of rotation the primary bearing tubes 34 are rotated about primary hinge's 30*a* and 30*b* axes rotation.

The hinge mechanisms 26*a* and 26*b* operate to divide the resistance provided by the weight stack 40 into a longitudinal component and a lateral component. These separated components of resistance increase the effectiveness of the exercise by more consistently loading the muscles throughout the range of motion and in addition, provide feedback to the user that encourages symmetrical exercise paths of the right and left hands.

Figure 5:
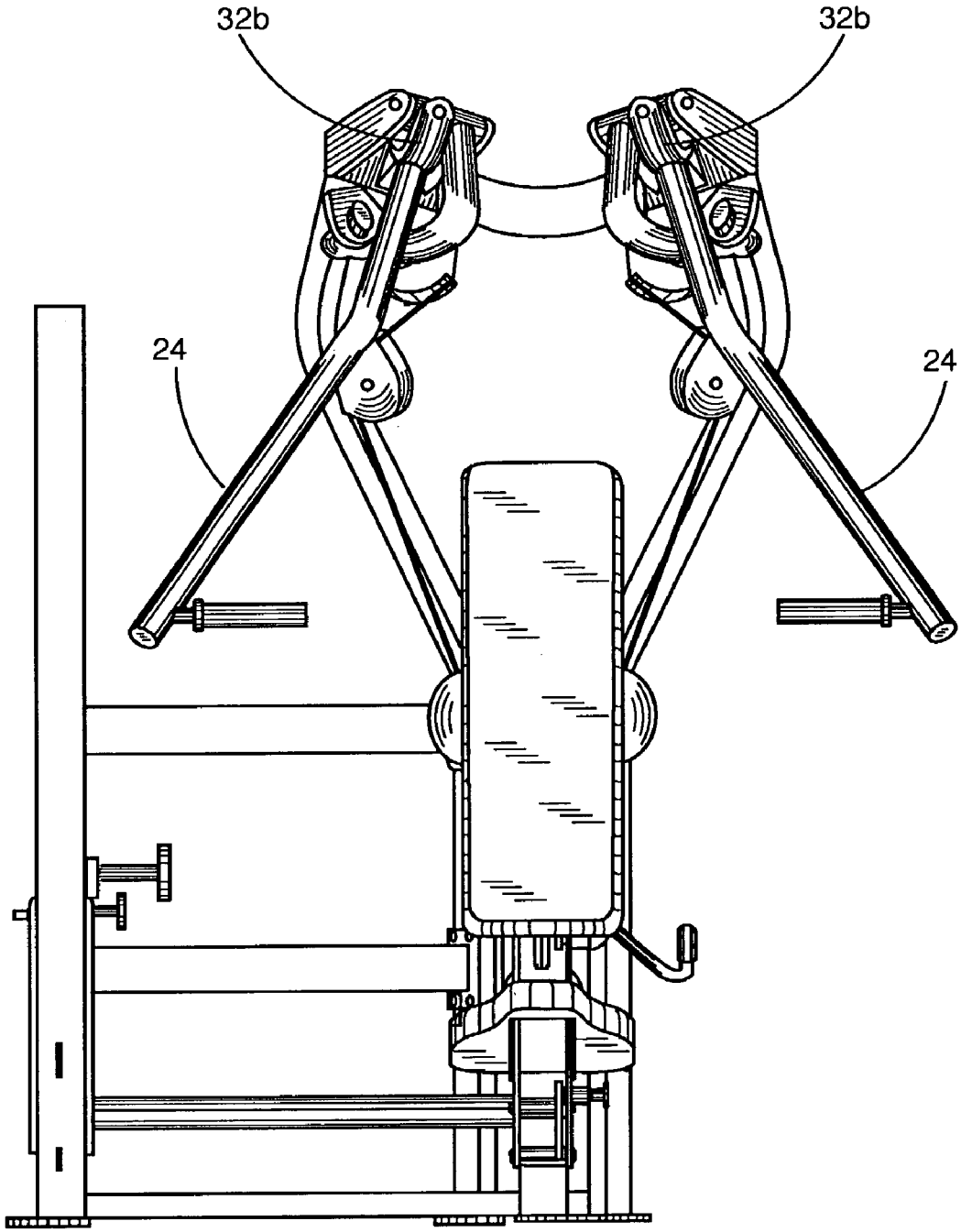
FIG. 5 is a front view of a chest press machine of the present invention.

In an embodiment, as shown in FIGS. 1 and 4, the arms 24 are rigidly attached to the secondary hinges 32*a* and 32*b*, at an inclination to the rotational axes of the secondary hinges 32*a* and 32*b*. (See also FIG. 5). At a point distal to the secondary bearing tubes the arms curve to become essentially perpendicular to the secondary hinge axes. Handles 60 are mounted at the end of the arms 24 distal to the secondary bearing tubes 38. The handles 60 present the user with a barbell grip. Alternatively, a variable position handle such as a pivoting handle, or a pad for pushing with the user's arm, wrist or elbow, can be attached to the arm to permit the user to perform other exercises.

In an exemplary embodiment, as shown in FIG. 1, a weight stack brace 42 is attached to the support frame 12 by beams 44, such that the weight stack 40 is easily accessed by a user seated in seat 20. Chevron-shaped bridges 46*a* and 46*b* (See also FIG. 3) are rigidly mounted to the front leg 14 and the weight stack brace 42, respectively. The chevron-shaped bridges 46A and 46*b* support a transmission 48, including a shaft 50, a first cam 52 and a second cam 54. (See also FIG. 6) A weight stack pulley set 56*a* and 56*b* is mounted to the top of the weight stack brace 42, with pulley 56*a* aligned with the first cam 52 and pulley 56*b* aligned with the weight stack 40. Rails 58 are mounted vertically within the weight stack brace 42. Weight stack 40 is slidingly mounted to the rails 58 and provides a resistance to the exercise.

In alternative embodiments, other mechanisms for providing resistance, such as friction fitting, springs, elastic bands, pneumatic, hydraulic, electromagnetic resistance, or an air resistance fan can be employed (either alone or in combination) and still practice the invention. Additionally, free weights can be operably engaged to the arms 24 to resist the movement.

In still a further embodiment (not shown), the resistance can be provided by weighted plates disposed directly on the arms 24, as is known in the art.

In an embodiment, as shown in FIGS. 1 and 3, pivot arms 62 are mounted to the primary bearing tube 34. A bumper arm 64 is mounted to the pivot arm 62 distal to the primary bearing tube 34. The bumper arm 64 has a bumper 66 at its distal end positioned to contact the arms 24. As the arms 24 are spread apart, the bumpers 66 engage the arms 24. In the rest position, the bumper arm 64 operates to limit the lateral range of motion of the handles 60 and to define a lateral starting position. As the users moves arms 24 through the exercise ranges, bumpers 66 define the maximum outward lateral range available for the arms 24 and in turn the handles 60.

In the rest position the arms 24 extend laterally outward and longitudinally forward from the secondary hinge 32*a* and 32*b*, contacting the bumpers 66. In an embodiment, the arm 24 would fall towards the midline due to the position of its center of gravity with respect to the location of the secondary hinge. To prevent this, torsion springs 80 are wrapped around secondary hinge tubes 38 and located in such a way to provide a counter balance for arms 24. (See also FIG. 4). This enables the user to sit in the seat 20 without having to move the arms 24 out of the way, and keeps the handles 60 in the exercise starting position.

Figure 6:
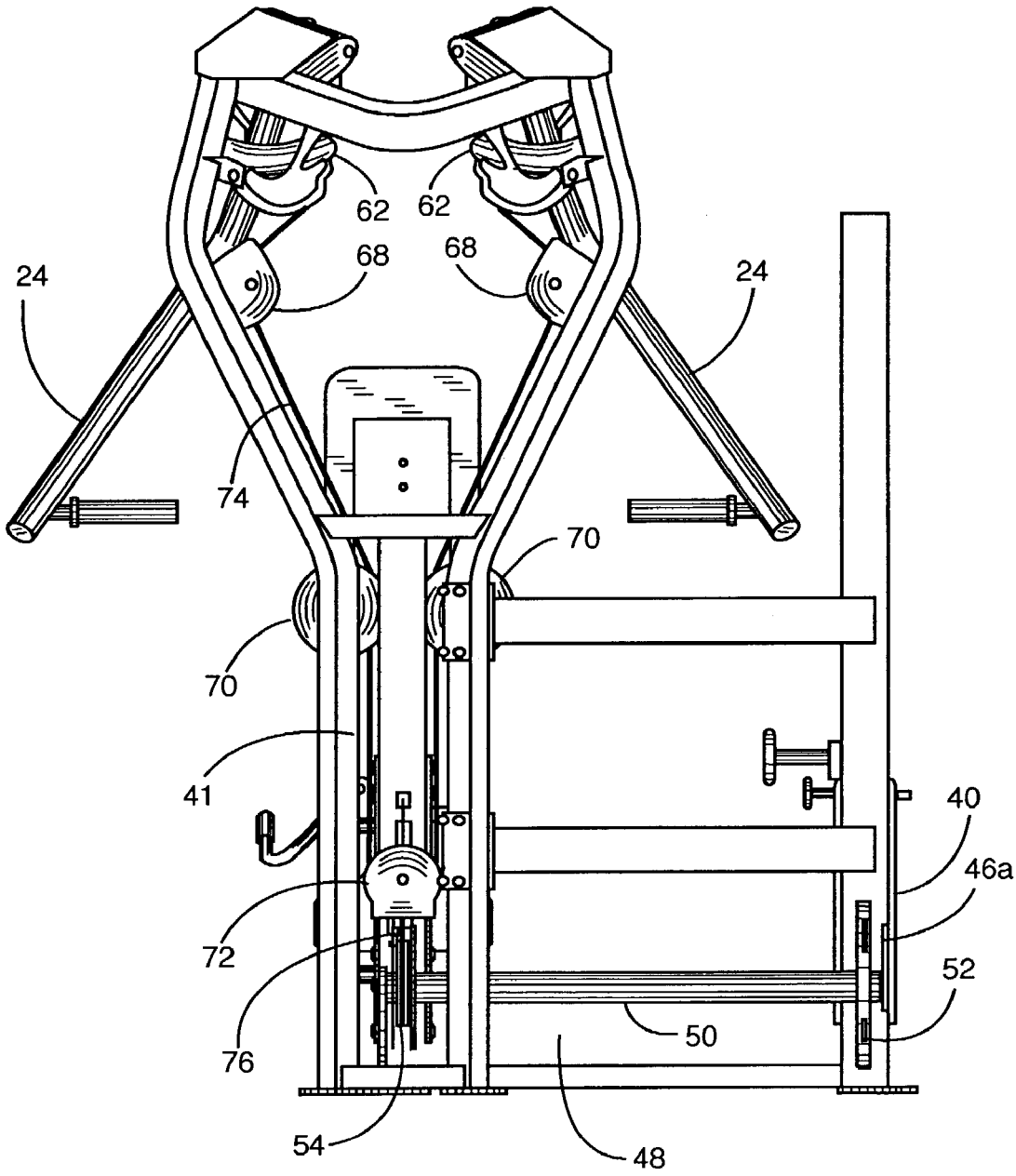
FIG. 6 is a rear view of a chest press machine of the present invention.

In an embodiment, a shown in FIG. 6, the pivot arms 62 are operably connected to the weight stack 40 via the transmission system 48. A first pair of frame pulleys 68 are mounted to the vertical support 18 of the support frame 12. A second pair of frame pulleys 70 are mounted to the front leg 14 of the support frame 12, wherein the second pair of frame pulleys 70 are mounted below and inline with the first pair of frame pulleys 68. (See also FIG. 2) A lifting pulley 72 is operably connected to the arms 24 by a first cable 74, wherein the first cable 74 is threaded about and through the first pair of frame pulleys 68 and second pair of frame pulleys 70, such that the lifting pulley 72 is positioned above second cam 54. A second cable 76 connects the lifting pulley 72 to the second cam 54, such that the second cam 54 is caused to rotate when at least one of the arms 24 is extended.

Figure 7:
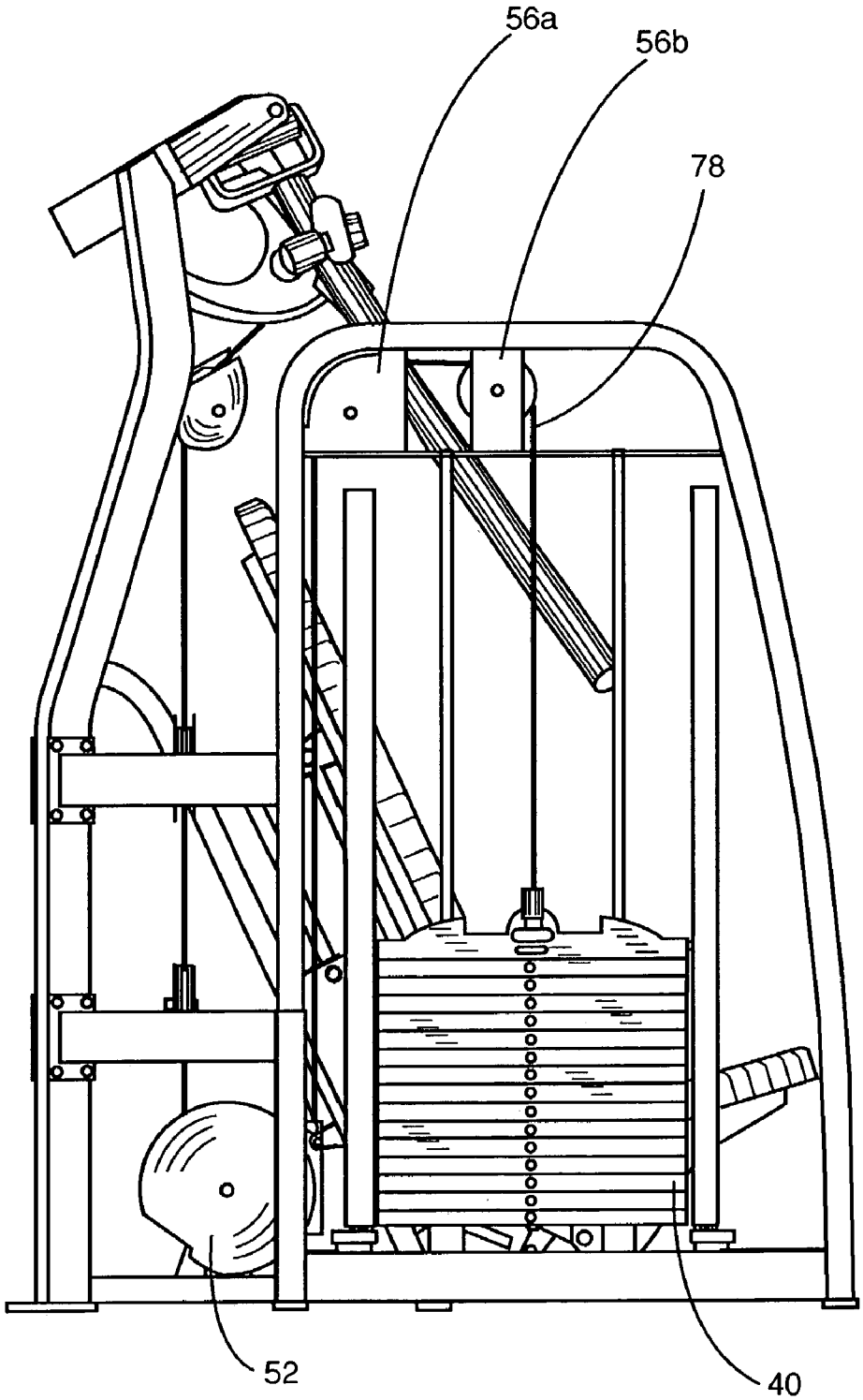
FIG. 7 is a right side view of a chest press machine of the present invention.

A belt 78 is attached at one end to the first cam 52 and extends over the weight stack pulleys 56*a* and 56*b* and is attached to the weight stack 40. (See also FIG. 7). As the user presses forward or inward on the handles 60, the lifting pulley 72 is raised, causing the second cable 76 to unwind and rotate the second cam 54. As the second cam 54 rotates, the shaft 50 and the first cam 52 rotate as well. The rotation of the first cam 52 pulls the belt 78 over the weight stack pulleys 56*a* and 56*b*, and thus lifts the weight stack 40.

In an exemplary method of operation, a weight is selected on the main weight stack 40 by placing a pin (not shown) in one of the holes, as is known in the art. The user adjusts the seat 20 to a suitable position on the front leg 14. For example, a user with a longer torso will adjust the seat to a lower height such that the handles 60 are positioned at a comfortable height near the user's chest. The user then grasps the handles 60 and pushes forward. The movement of the handles 60 causes the arms 24 to move which, in turn, cause the primary and secondary bearing tubes 34 and 38 to move. The movement of the primary and secondary bearing tubes 34 and 38 causes the lifting pulley 72 to be raised. As the lifting pulley 72 is raised, the second cam 54, shaft 50, and first cam 52 rotate, pulling on the belt 78 and lifting the selected weight. The user then returns the handles 60 to the initial position, thereby lowering the weight. When the user pushes the handles 60 forward (concentric action), the resistance provided by the weight is overcome. When the user returns the handles 60 (eccentric action), the user succumbs to the resistance provided by the weight.

The hinge mechanisms 26*a* and 26*b* permit the handles 60 to be independently or in combination moved forward (i.e., longitudinally) and inward (i.e., laterally) in a relationship selected by the user. Consequently, the user can grasp the handles 60 and push forward and inward in a natural arcuate path. Alternatively, the user can select another path to give the muscles a different workout. The two different modes of operation available to the user are machine defined path or user defined path. In the machine defined path, the user would push in the forward direction and the arms would be restricted to a natural converging path motion defined by the angular orientation of the primary axis which would be approximately 20 to 25 degrees convergent per side toward the midline of the machine. No path of motion less convergent than the machine defined path would be available to the user. Under the second mode of operation, the user would start out by pushing inward as well as forward. In this mode once the user exceeds a component of lateral force set by the machine geometry, they are free to move inward as much as desired in addition to moving forward. In the user defined mode, any path of motion that is more convergent than the machine defined path is available to the user at any time.

It should be understood that the dual axis, dual hinge mechanisms 26*a* and 26*b* may be incorporated in machines, such as an incline, decline, or flat chest press machines, and overhead shoulder press machines. Alternatively, the independent dual axis, dual hinge mechanisms can be incorporated in an upper torso pulling exercise machine, such as a Lat Pull, a Rear Deltoid pull, a row, or and an incline row machine, enabling a user to maintain a selected biomechanical motion, while maintaining a consistent resistance applied to the muscles, in the stability of an exercise machine.

Figure 8:
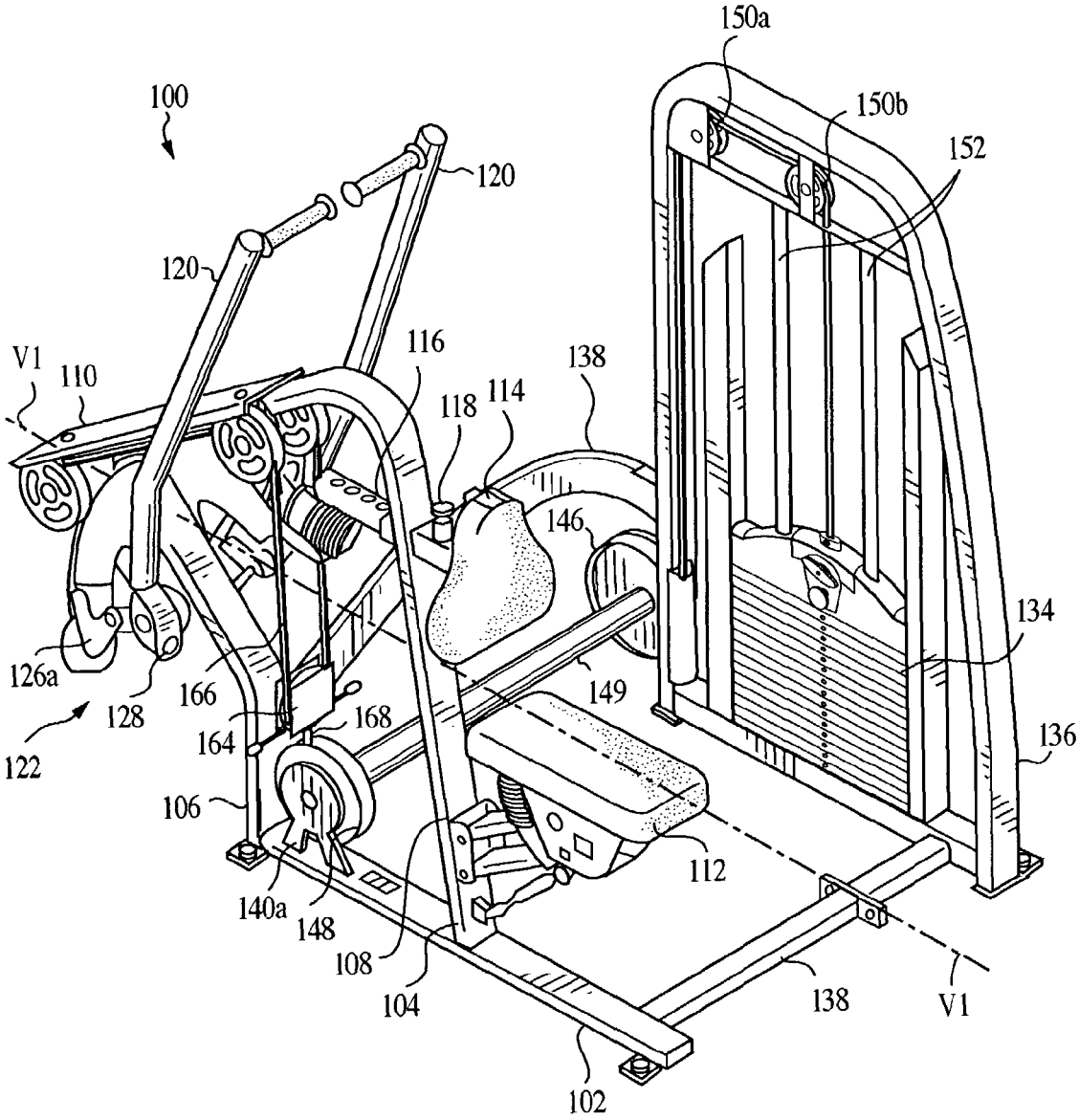
FIG. 8 is a perspective view of an incline pull machine of the present invention.
Figure 9:
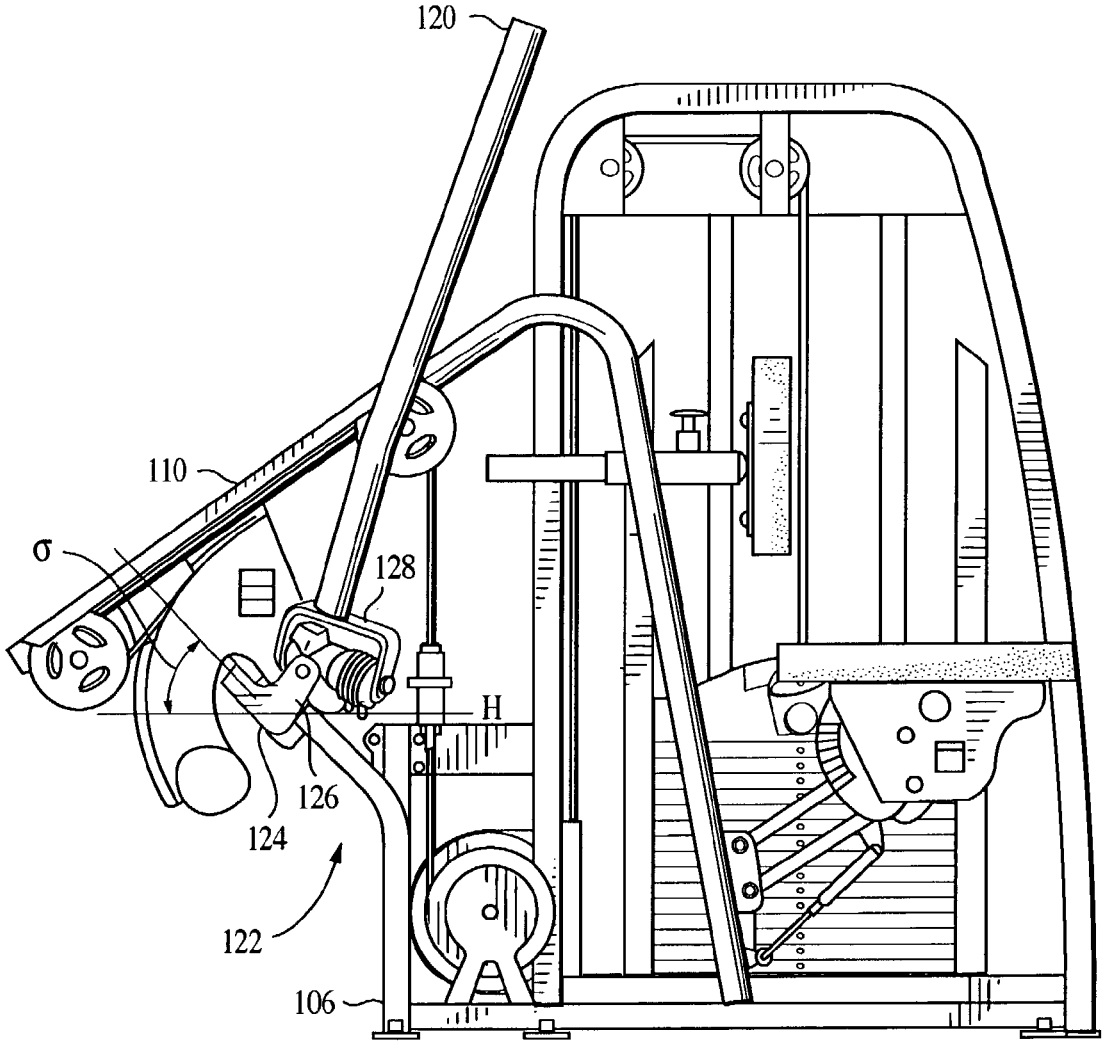
FIG. 9 is left side view an incline pull machine of the present invention.

In an exemplary embodiment, as shown in FIGS. 8 and 9, an incline pull exercise machine 100 of the present invention includes a support frame 102 having a front leg 104 and rear leg 106, where the front leg 104 has a proximal portion 108 and a distal portion 110. A pair of arms 120 are mounted to the support frame 102, each by an independent dual axis, dual hinge mechanisms 122. The hinge mechanisms 122 are mounted on rear leg 106 with hinge bracket 124, where the hinge mechanism 122 are symmetrically mounted about a first vertical plane "V1" bisecting the hinge bracket 124 and defining the midline of the exercise machine 100. The hinge bracket 124 is mounted to the rear leg 106, such that the hinge mechanisms 122 are at an angle "σ" from the horizontal plane "H", wherein the angle "σ" can be between about +10 degrees to about +60 degrees. The hinge mechanisms 122 each include a primary hinge 126 and secondary hinge 128. The primary hinges 126 are mounted to the hinge bracket 124 and the arms 120 are mounted to the secondary hinges 128.

Figure 10:
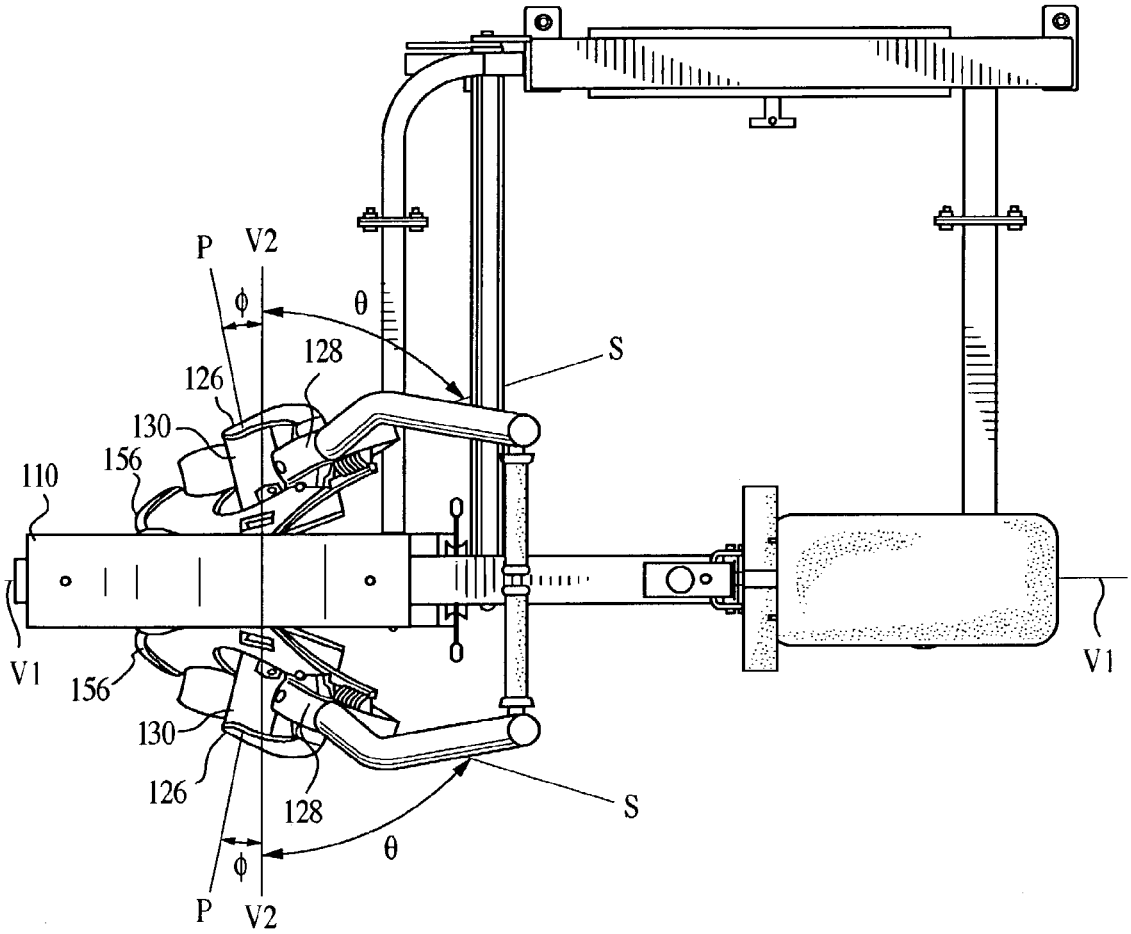
FIG. 10 is a top view of an incline pull machine of the present invention.

As shown in FIG. 10, the primary hinges 126 are mounted as non-parallel, non-planar mirror images of each other, disposed in a skewed orientation to the first vertical plan "V1". The primary hinges 126 are mounted to the hinge bracket 124 such that the rotational axes "P" of the primary hinges 126 are at an angle "φ" to a vertical plane "V2," where vertical plane "V2" orthogonal to vertical plane "V1". The angle "φ" can be between about 10 degrees to about 45 degrees, wherein for the exemplary machine "φ" can be between about 20 degrees to about 25 degrees. The secondary hinges 128 are mounted to the primary hinges 126, such that the rotational axes "S" of the secondary hinges 128 are skewed with respect to the rotational axes "P" of the primary hinge 126; in other words, the secondary hinges 128 rotational axes "S" are not parallel to the primary hinges 126 rotational axes "P". The rotational axes of the secondary hinges 128 are at an angle "θ" to the rotational axes of the primary hinges 126. The angle "θ" can be between about 80 degrees to about 100 degrees, wherein for the exemplary machine "θ" is about 90 degrees.

Figure 11:
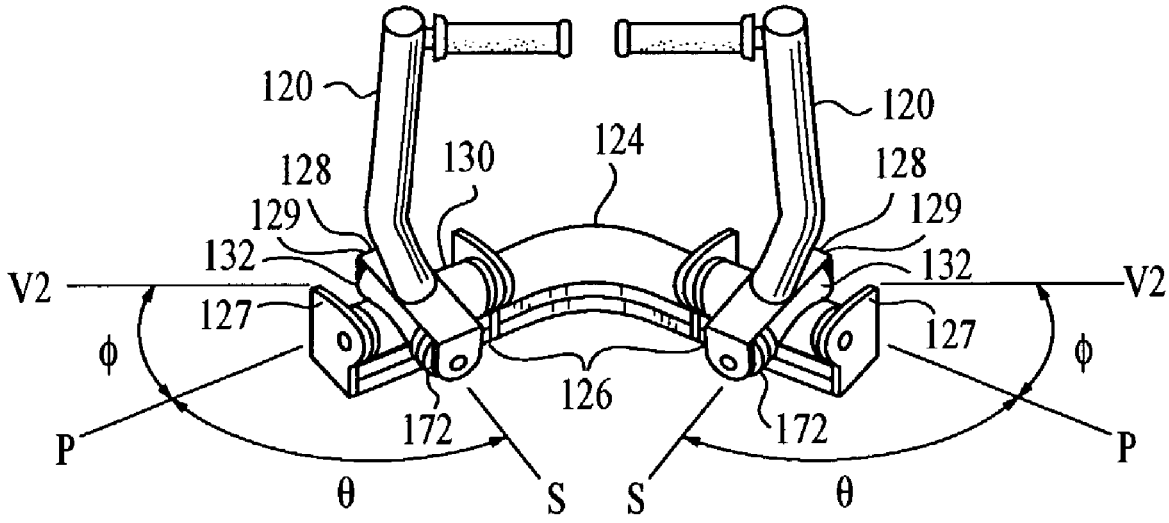
FIG. 11 is a top perspective view of the dual axis, dual hinge mechanisms of an incline pull machine of the present invention.

As shown in FIG. 11, the primary hinges 126 each include a primary u-shape bracket 127 and a primary bearing tube 130 mounted on sealed bearings (not shown) and rotatable about the rotational axes "P" of the primary hinges 126. The secondary hinges 128 each include a secondary u-shaped bracket 129 and a secondary bearing tube 132 mounted to sealed bearings (not shown) and rotatable about the rotational axes "S" of the secondary hinges 128. The primary unshaped brackets 127 are affixed to the hinge bracket 124. The secondary bearing tubes 132 are affixed to the primary bearing tubes 130, such that as the secondary bearing tubes 132 are rotatable about the rotational axes "S" of the secondary hinges 128 and the primary bearing tubes 130 are rotatable about the rotational axes "P" of the primary hinges 126. Cable guides 156 are mounted to the primary bearing tube 130, the cable guides 156 are substantially planar elements having a grooved upper edge for receiving a cable. (See also FIG. 10) The arms 120 are affixed to the secondary unshaped brackets 129, such that as the arms 120 are moved the primary bearing tubes 130 rotate, causing the cable guides 156 to rotate.

The hinge mechanisms 122 operate to divide the resistance provided by the resistance mechanism into a longitudinal component and a lateral component. These separated components of resistance increase the effectiveness of the exercise by more consistently loading the muscles throughout the range of motion and in addition, provide feedback to the user that encourages symmetrical exercise paths of the right and left hands.

Figure 12:
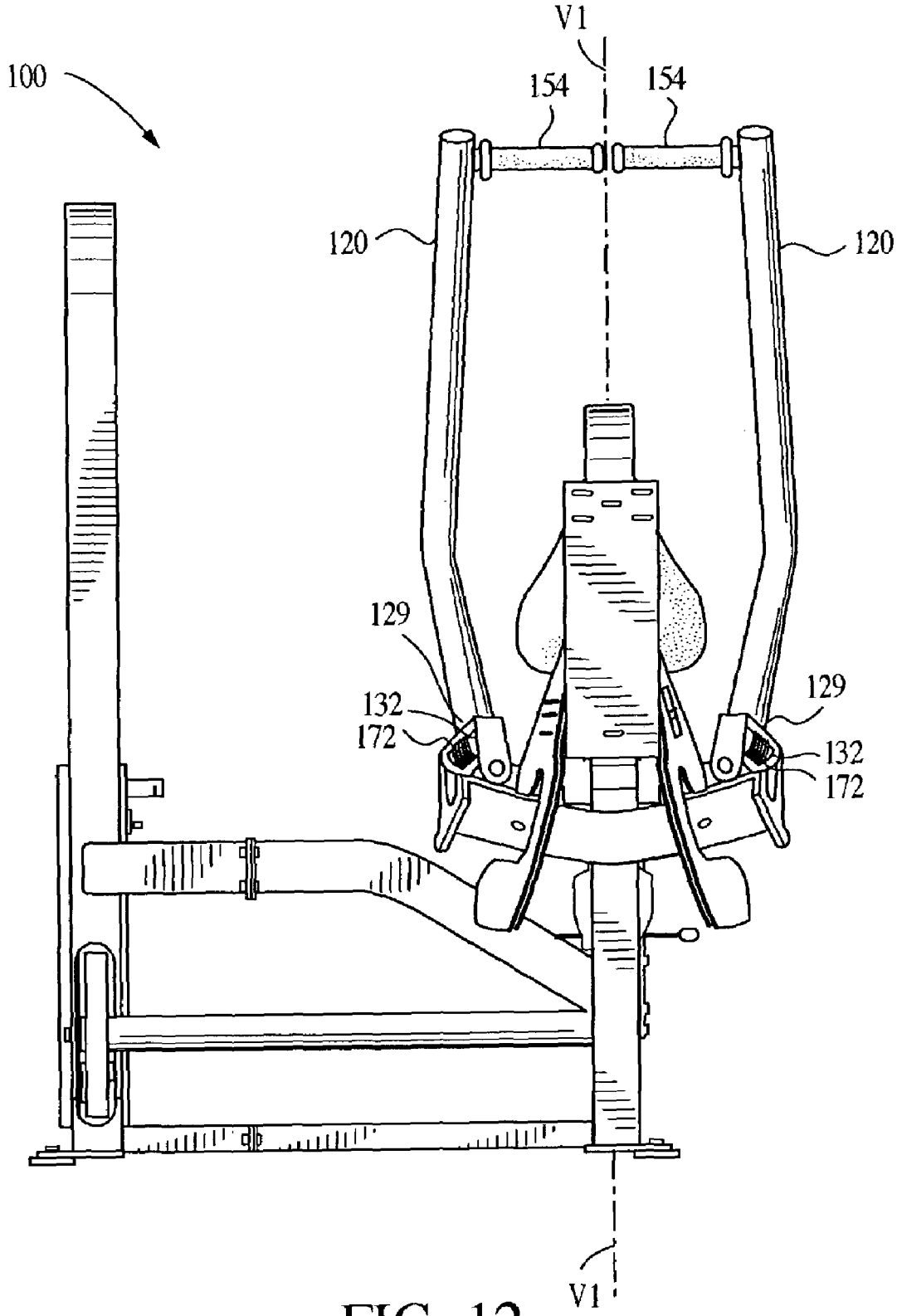
FIG. 12 is a front view of an incline pull machine of the present invention.

As shown in FIG. 12, the arms 120 are rigidly attached to the secondary unshaped brackets 129, at an inclination to the rotational axes of the secondary hinges 128. At a point distal to the secondary bearing tubes 132, the arms 120 curve so as to converge toward the vertical plane "V1", the midline of the exercise machine 100. Handles 154 are mounted at the end of the arms 120 distal to the secondary bearing tubes 132. The handles 154 present the user with a barbell grip. Alternatively, a variable position handle such as a pivoting handle can be attached to the arms to permit the user to perform other exercises.

The hinge mechanisms 122 permit the handles 154 to be independently or in combination moved longitudinally and laterally in a relationship selected by the user. Consequently, the user can grasp the handles 154 and pull down and outward in a natural arcuate path. Alternatively, the user can select another path to give the muscles a different workout. The two different modes of operation available to the user are a machine defined path or a user defined path. In the machine defined path, the user pulls in the downward direction and the arms are restricted to a natural diverging path motion defined by the angular orientation of the primary axis which is approximately 20 to 25 degrees divergent per side away from the midline of the machine. No path of motion less divergent than the machine defined path is available to the user. Under the second mode of operation, the user starts out by pulling outward as well as downward. In this mode once the user exceeds a component of lateral force set by the machine geometry, the user is free to move outward as much as desired in addition to moving downward. In the user defined mode, any path of motion that is more divergent than the machine defined path is available to the user at any time.

In the rest position the arms 120 extend laterally inward and longitudinally up and back from the secondary hinge 128. In the embodiment, the arms 120 would fall away the midline due to the position of their center of gravity with respect to the location of the secondary hinge 12. To prevent this, a retention device is operably connected to the arms, acting to balance the arms 120. For example, the retention device is a pair of torsion springs 172, each wrapped around secondary bearing tubes 132 and located in such a way to provide a counterbalance for arms 120. (See also FIG. 11).

A seat 112 is mounted to the proximal portion 108 of the front leg 104 of the support frame 102. The seat 112 is adapted to be positioned at various heights along the front leg 104 to provide a comfortable seating position and alignment of the shoulders for users of varying stature. A chest pad 114 is mounted on the front leg 104 above the seat 112 by a chest pad rod 116. The chest pad rod 116 may be of an adjustable length, such as by means of a telescoping rod held in position by a pin/detent connection 118. The adjustable-length chest pad rod 116 allows users of varying arm length to be positioned at different distances from the machine, thereby permitting a full range of motion. The seat 112 and backrest 114 comprise a user support adapted to maintain the user in a comfortable position for exercising.

While the primary hinges 126 are disposed directly in front of the chest pad 114 and below the seat 112, they can be located in other positions and still practice the invention. In particular, the primary hinges 126 can be positioned in front of chest pad and above the seat 112 to vary the direction of handle motion, providing a pull down or row exercise.

As shown in FIG. 8, a weight stack brace 136 is attached to the support frame 102 by beams 138, such that the weight stack 134 is easily accessed by a user seated in seat 112. Chevron-shaped bridges 140*a* and 140*b* (see also FIG. 13) are rigidly mounted to the support frame 102 and the weight stack brace 136, respectively. The chevron-shaped bridges 140*a* and 140*b* support a transmission, including a shaft 149, a first cam 146, and a second cam 148. A weight stack pulley set 150*a* and 150*b* is mounted to the top of the weight stack brace 136, with pulley 150*a* aligned with the first cam 146 and pulley 150*b* aligned with the weight stack 134. Rails 152 are mounted vertically within the weight stack brace 136. Weight stack 134 is slidingly mounted to the rails 150 and provides a resistance to the motion of the arms 120.

Figure 13:
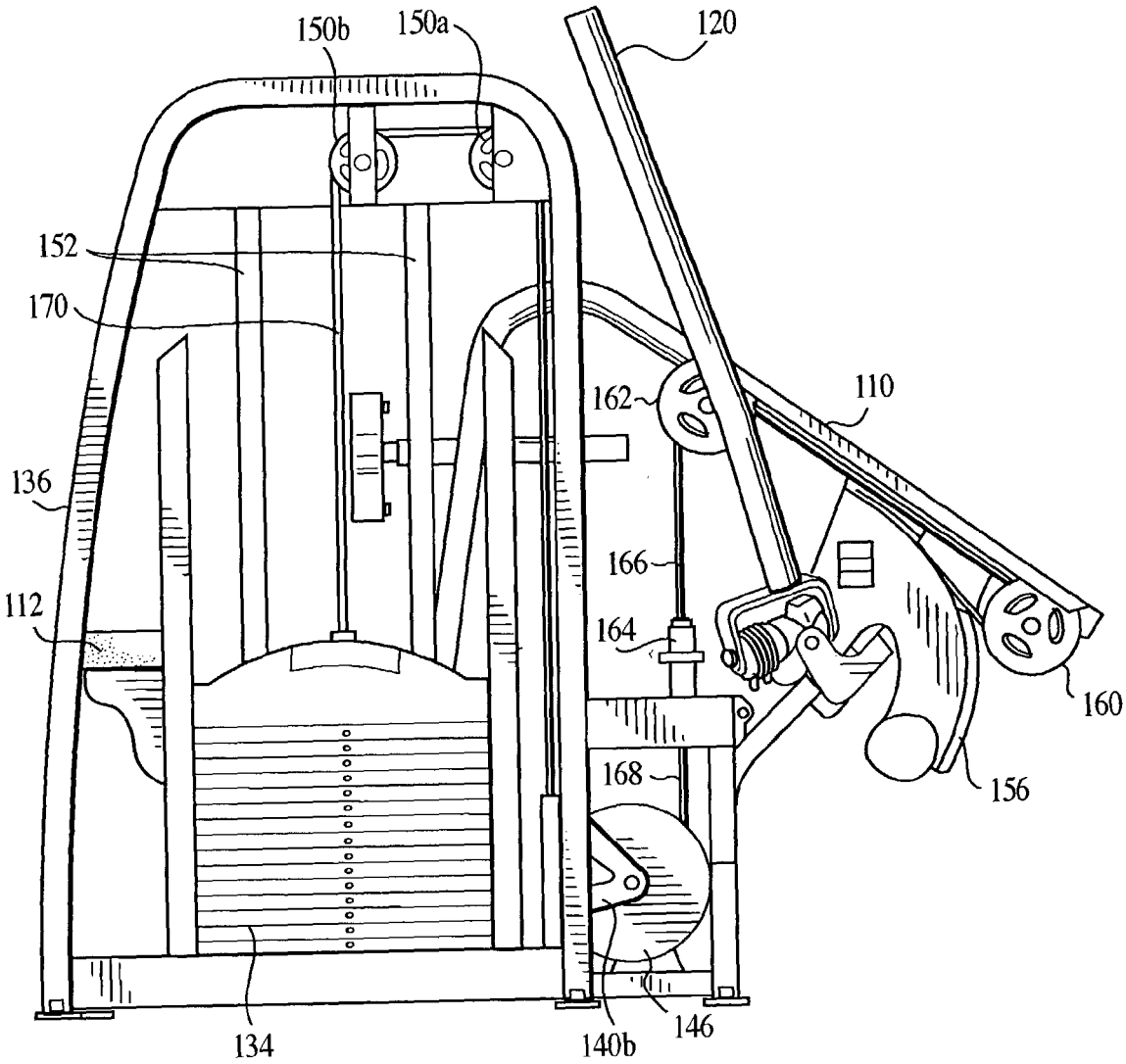
FIG. 13 is a right side view of an incline machine of the present invention.

As shown in FIG. 13, the arms 120 are operably connected to the weight stack 134 via the transmission system, where a first pair of frame pulleys 160 and second pair of frame pulleys 162 are mounted to the distal portion 108 of the front leg 104. A lifting pulley 164 is operably connected to the arms 120 by a first cable 166, wherein the first cable 166 is threaded about and through the first pair of frame pulleys 160, second pair of frame pulleys 162 and the lifting pulley 164, the ends of which are connected to the cable guides 156, such that the lifting pulley 164 is positioned above second cam 148. (See also FIG. 8) A second cable 168 connects the lifting pulley 164 to the second cam 148, such that the second cam 148 is caused to rotate when at least one of the arms 120 is drawn back.

The first cam 146 is operably connected to the weight stack 134 by a belt 170. A first end of the belt 170 is attached to the first cam 146, with the belt 170 extending over the weight stack pulleys 150*a* and 150*b*, and the opposite end of the belt 170 is attached to the weight stack 134. As the user pulls down or outward on the arms 120, the lifting pulley 164 is raised, causing the second cable 168 to unwind and rotate the second cam 148. As the second cam 148 rotates, the shaft 144 and the first cam 146 rotate as well. The rotation of the first cam 146 pulls the belt 170 over the weight stack pulleys 150*a* and 150*b*, and thus lifts the weight stack 134.

In an exemplary method of operation, a weight is selected on the main weight stack 134 by placing a pin (not shown) in one of the holes, as is known in the art. The user adjusts the seat 112 and chest pad 114 to a suitable position on the front leg 104. The user then grasps the handles 154 and pulls the handle 154 downward either in unison or alternately. The movement of the handles 154 causes the arms 120 to move which, in turn, causes the primary and secondary bearing tubes 130 and 132 to move. The movement of the primary and secondary bearing tubes 130 and 132 causes the lifting pulley 164 to be raised. As the lifting pulley 164 is raised, the second cam 148, shaft 144, and first cam 146 rotate, pulling on the belt 170 and lifting the selected weight. The user then returns the handles 154 to the initial position, thereby lowering the weight. When the user pulls the handles 154 downward (concentric action), the resistance provided by the weight is overcome. When the user returns the handles 154 (eccentric action), the user succumbs to the resistance provided by the weight.

The hinge mechanisms 122 permit the handles 154 to be independently or in combination moved longitudinally and laterally in a relationship selected by the user. Consequently, the user can grasp the handles 154 and pull down and outward in a natural arcuate path. Alternatively, the user can select another path to give the muscles a different workout. The two different modes of operation available to the user are a machine defined path or a user defined path. In the machine defined path, the user pulls in the downward direction and the arms are restricted to a natural diverging path motion defined by the angular orientation of the primary axis which is approximately 20 to 25 degrees divergent per side away from the midline of the machine. No path of motion less divergent than the machine defined path is available to the user. Under the second mode of operation, the user starts out by pulling outward as well as downward. In this mode once the user exceeds a component of lateral force set by the machine geometry, the user is free to move outward as much as desired in addition to moving downward. In the user defined mode, any path of motion that is more divergent than the machine defined path is available to the user at any time.

It should be understood that the dual axis, dual hinge mechanisms 122 may be used on other upper torso weight machines, for example a pull down, high row, low row, or row exercise machines.

It will be appreciated by persons skilled in the art that the subject invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An exercise machine for exercising the muscles of the back comprising:

a frame, a seat and a chest pad mounted to the frame, a first arm; and a second arm proximate to the first arm, the first arm and the second arm being pivotably mounted in a rest position forwardly and extending upwardly of the seat, the arms being downwardly pivotable from the rest position along constantly divergent machine defined paths around first and second axes that are angled relative to each other, wherein the arms are also pivotable along a plurality of user selectable paths, wherein the plurality of user selectable paths of the first arm and the plurality of user selectable paths of the second arm are constrained to be selectively divergent from the constantly divergent machine defined paths.

2. The exercise machine according to claim 1 wherein the angled axes are generally horizontally disposed.

3. The exercise machine according to claim 1 wherein each of the first and second axes are disposed at an angle of 10 degrees or more relative to a vertical plane.

4. The exercise machine according to claim 3 wherein the frame and the seat are arranged on the frame for exertion of a pulling force by a user seated on the seat on the arms, the arms being arranged on the frame such that the arms are movable along the machine defined paths on exertion of a pulling force by the user, the arms being selectively divergent by the user at all positions along the constantly divergent machine defined paths.

5. The exercise machine according to claim 4, wherein the arms are pivotably mounted via a pair of dual axis, dual hinge mechanisms which comprise: a pair of primary hinges mounted to the frame defining a pair of non-parallel primary rotational axes in skewed orientation to the frame; and a pair of secondary hinges mounted to the pair of primary hinges defining a pair of nonparallel secondary rotational axes in a skewed orientation to the pair of primary axes of rotation.

6. The exercise machine according to claim 5, wherein the primary hinges each include a primary bearing tube and the secondary hinges each include a secondary bearing tube, the secondary bearing tubes are affixed to the primary bearing tubes.

7. The exercise machine according to claim 6, wherein a torsional spring is wrapped about each of the secondary bearing tubes.

8. The exercise machine according to claim 5, wherein the first arm and the second arm are connected to one each of the secondary hinges.

9. The exercise machine according to claim 1, wherein the chest pad is mounted to the frame proximal to the seat.

10. The exercise machine according to claim 1, wherein the arms each include a handle.

11. The exercise machine according to claim 1, wherein the arms each include a retention device.

12. An exercise machine for exercising muscles of the back comprising:

a frame, a seat and a chest pad mounted to the frame;

a first arm pivotably connected to the frame;

a second arm pivotably connected to the frame proximate to the first arm, the first arm and the second arm being pivotably mounted in a rest position forwardly and extending upwardly of the seat, the arms being downwardly pivotable from the rest position along constantly divergent machine defined paths, each arm also being pivotable along a plurality of user modified machine paths, wherein the machine defined paths are constantly divergent around generally horizontal axes and the plurality of user modified machine paths are constrained to be selectively divergent from the constantly divergent machine defined paths; and a resistance mechanism operably connected to the first arm and the second arm.

13. The exercise machine according to claim 12 wherein the generally horizontal axes are angled relative to each other.

14. The exercise machine according to claim 13 wherein the frame and the seat are arranged on the frame for exertion of a pulling force by a user seated on the seat on the arms, the arms being arranged on the frame such that the arms are movable along the machine defined paths on exertion of a pulling force by the user, the arms being selectively divergent by the user at all positions along the constantly divergent machine defined paths.

15. The exercise machine according to claim 12, further comprising a pair of dual axis, dual hinge mechanisms independently mounted to the frame; wherein the first arm and the second arm are attached to one each of the pair of dual axis, dual hinge mechanisms.

16. The exercise machine according to claim 15, wherein the pair of dual axis, dual hinge mechanisms comprise: a pair of primary hinges mounted to the frame defining a pair of non-parallel primary rotational axes in skewed orientation to the frame; and a pair of secondary hinges mounted to the pair of primary hinges defining a pair of nonparallel secondary rotational axes in a skewed orientation to the pair of primary axes of rotation.

17. The exercise machine according to claim 16, wherein the primary hinges each include a primary bearing tube and the secondary hinges each include a secondary bearing tube, the secondary bearing tubes are affixed to the primary bearing tubes.

18. The exercise machine according to claim 17, wherein the first arm and the second arm are connected to one each of the secondary hinges.

19. An exercise machine for exercising muscles of the back comprising:

a frame;

a pair of primary hinges mounted to the frame defining a pair of non-parallel primary rotational axes in skewed orientation to the frame, the primary hinges each including a primary bearing tube;

a pair of secondary hinges mounted to the pair of primary hinges defining a pair of nonparallel secondary rotational axes in a skewed orientation to the pair of primary axes of rotation, the secondary hinges each including a secondary bearing tube, wherein the secondary bearing tubes are affixed to the primary bearing tubes;

a first arm and a second arm mounted to one each of the pair of secondary hinges, the first arm and the second arm each including a machine defined path and a plurality of user selectable paths, wherein the first arm and the second arm being pivotably mounted in a rest position forwardly and extending upwardly of the seat, the arms being downwardly pivotable from the rest position along the machine defined paths which are constantly divergent;

the plurality of user selectable paths of the first arm and the plurality of user selectable paths of the second arm being constrained to be selectively divergent from the constantly divergent machine defined paths;

a pair of handles connected one each to the first arm and the second arm;

a user support structure in proximal relation to the first arm and the second arm, the user support structure including a seat mounted to the frame and a chest pad mounted to the frame proximal to the seat; and a resistance mechanism including a weight stack operably connected to first arm and the second arm.

20. An exercise machine for exercising the muscles of the back comprising:

a first arm; and a second arm proximate to the first arm, the first arm and the second arm being pivotable along machine defined paths and a plurality of user selectable paths, wherein the machine defined paths are constantly divergent and the plurality of user selectable paths of the first arm and the plurality of user selectable paths of the second arm are constrained to be selectively divergent by a user from the constantly divergent machine defined paths, wherein the machine includes a frame, a chest pad, and a seat arranged on the frame for exertion by the user seated on the seat of a pulling force on the arms, the arms being arranged on the frame such that the first arm and the second arm are pivotably mounted in a rest position forwardly and extending upwardly of the seat, the arms being downwardly pivotable from the rest position along the constantly divergent machine defined paths on exertion of a pulling force by the user, the arms being selectively divergent by the user at all positions along the constantly divergent machine defined paths.

* * * * *